United States Patent [19]

Holloway

[11] Patent Number: 4,777,969

[45] Date of Patent: Oct. 18, 1988

[54] ROTATIONAL COSMETIC COMPACT

[75] Inventor: Thomas F. Holloway, Southbury, Conn.

[73] Assignee: Risdon Corporation, Naugatuck, Conn.

[21] Appl. No.: 801,824

[22] Filed: Nov. 26, 1985

[51] Int. Cl.[4] ..... A45D 40/00

[52] U.S. Cl. ..... 132/314; 206/823

[58] Field of Search ..... 132/79 R, 79 A, 79 B, 132/79 C, 79 D, 79 E, 79 F, 79 G, 82 R, 82 A, 82 B, 82 C, 82 D, 82 E, 82 F; 220/253; 206/823

[56] References Cited

U.S. PATENT DOCUMENTS

| | | | |
|---|---|---|---|
| 505,823 | 10/1893 | Faber | 132/79 R |
| 1,896,976 | 2/1933 | Schifferdecker | 220/253 |
| 2,214,437 | 9/1940 | Punte et al. | 220/253 |
| 2,487,825 | 11/1949 | Olvis | 132/79 R |
| 3,159,163 | 12/1964 | Curti | 132/79 R |
| 3,482,728 | 12/1969 | Flax | 132/79 A |
| 3,502,089 | 3/1970 | Paradis | 132/82 R |
| 3,726,432 | 4/1973 | Gentile | 220/253 |
| 4,181,218 | 1/1980 | Cox | 220/253 |
| 4,544,063 | 10/1985 | Neward | 220/253 |
| 4,679,692 | 7/1987 | Davey | 132/79 F |

FOREIGN PATENT DOCUMENTS

| | | | |
|---|---|---|---|
| 245441 | 7/1926 | Italy | 220/253 |
| 2152904 | 8/1985 | United Kingdom | 132/82 A |

*Primary Examiner*—John J. Wilson
*Assistant Examiner*—Cary E. Stone
*Attorney, Agent, or Firm*—St. Onge Steward Johnston & Reens

[57] ABSTRACT

A cosmetic compact is described which houses a cosmetic preparation and applicator means in separate compartments. The cover of the compact is rotatable about the inner container and has an elongated slot which, upon rotation of the cover, is adapted to register with the receptacle containing the cosmetic preparation. Stimultaneously, an aperture in the cover registers with a corresponding opening in the compartment in which an applicator is stored and permits the latter to be released by appropriate tilting or like maneuvering of the compact. After use the applicator is returned to the storage compartment and the cover is rotated to return the compact to the closed position.

19 Claims, 1 Drawing Sheet

ROTATIONAL COSMETIC COMPACT

BACKGROUND OF THE INVENTION

1. Field of the Invention

This invention relates to a cosmetic compact and is more particularly concerned with an improved cosmetic compact for housing a cosmetic preparation and applicator means.

2. Description of the Prior Art

The majority of cosmetic compacts currently in use comprise a generally dish-shaped base having a receptacle for the cosmetic preparation housed therein and provided with a hinged lid and appropriate latch means for retaining the lid and base in closed position. This type of compact is generally somewhat bulky for storage in a woman's purse or like carrying means. When the cosmetic preparation is in powder form a dusting pad or like applicator is generally enclosed within the compact and is separated from the cosmetic powder by means of a suitable screen. However, when the cosmetic preparation is of a creamy nature, as is the case with eyebrow liner, rouge and the like, the necessary applicator brush or like means is generally carried in a separate container thus adding to the space required in a woman's purse.

A number of devices for dispensing cosmetics, tooth powders and the like, have been described which are substantially cylindrical in appearance and which occupy less space for storage when not in use. Such devices have also been described in which provision is made for housing applicator means in addition to the cosmetic or similar preparation.

Illustratively Goertz U.S. Pat. No. 1,712,496 shows a generally cylindrical container for housing a receptacle for a cosmetic preparation and an applicator therefor. The container is provided with a hollow cylindrical cover which has to be removed completely in order to gain access to the contents. Turnes U.S. Pat. No. 2,521,269 and Aversa U.S. Pat. No. 3,397,707 show closely related devices which also require removable covers.

Stevens U.S. Pat. No. 1,519,514 shows a powder dispensing device having a cap which fits in sliding engagement over the end of a cylindrical container. The cap and container have slots which can be aligned by rotation of the cap in order to dispense the powder.

Stevens U.S. Pat. No. 2,130,975 shows inner and outer cylindrical members rotatable relative to each other. The outer cylinder has a longitudinal slot which can be brought into alignment with an angled slot in the inner cylinder to dispense powder from the inner container on a brush or like applicator.

Eley U.S. Pat. No. 2,529,004 also shows inner and outer cylindrical members rotatable relative to each other. A slot in the outer member can be aligned by rotation of the member, with an open receptacle containing powder on the inner member, thus providing access to the powder for loading a toothbrush or like applicator.

Cylindrical compacts in which both cosmetic preparation and applicator can be housed in separate compartments, and to which access can be gained by rotation of the cover without removal thereof, have not been described heretofore.

SUMMARY OF THE INVENTION

It is an object of the invention to provide a cosmetic compact which is substantially cylindrical in shape, of a highly convenient size for easy storage, and aesthetically pleasing in appearance.

It is a further object of the invention to provide a cosmetic compact which is adapted to house both a cosmetic preparation and an applicator therefor and which can be opened by rotation of the cover about the body of the compact to retrieve the applicator and gain access to the cosmetic preparation.

These objects, and other objects which will become apparent from the description which follows, are achieved by the cosmetic compact of the invention. The latter, in its broadest aspect, comprises a hollow cylindrical cover having one end closed and provided with an elongated slot in the wall thereof, said cover being fitted, in rotatable sliding engagement, on an inner cylindrical member having both ends closed. The inner member has an open receptacle for a cosmetic preparation disposed in the wall thereof and also contains a compartment for storage of a cosmetic applicator. Rotation of the cover relative to the inner member causes the elongated slot in the cover to register with the opening of the receptacle for the cosmetic preparation on the inner member thus making the cosmetic preparation accessible by the user of the compact. The alignment of the slot and the receptacle in this manner also causes an aperture in the cover to register with a corresponding aperture in the storage compartment in the inner member and permits retrieval of the applicator therefrom by tilting the compact or by like manoeuvers.

DETAILED DESCRIPTION OF THE INVENTION

Figure 1:
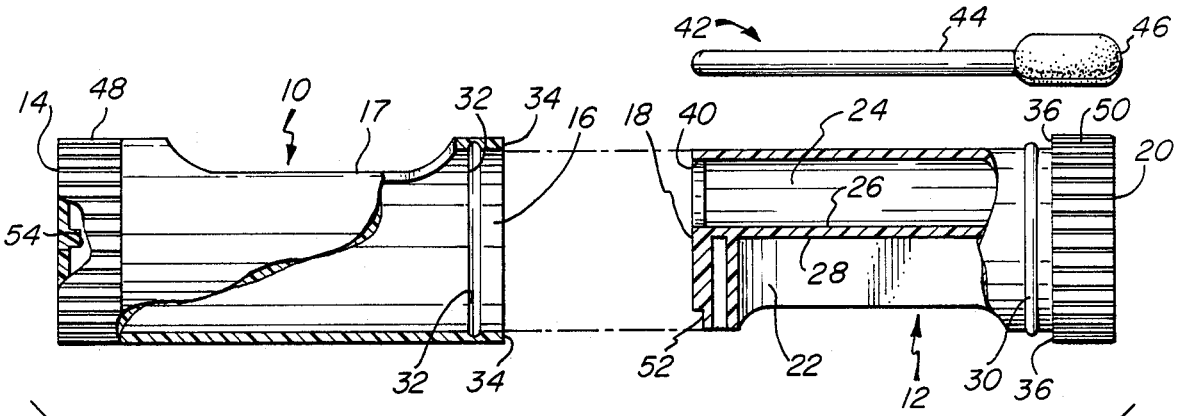
FIG. 1 is an exploded view, partially cut away, of a cosmetic compact in accordance with the invention.

The invention will now be illustrated by reference to the accompanying drawings. In the exploded view shown in FIG. 1 the cap 10 comprises a hollow cylindrical member having a closed end 14 and an open end 16 and having elongated slot 17 disposed in the wall thereof. The body 12 of the compact comprises an inner cylindrical member having both ends 18 and 20 closed. Receptacle 22 for receiving a cosmetic preparation and storage compartment 24 which extends substantially the whole length of the interior of the body 12 are separated from each other by divider panel 26. The latter panel also serves to form the floor 28 of receptacle 22. The receptacle is shown in the inverted position in FIG. 1 with the floor 28 uppermost and the open top facing downwardly.

The cap 10 and body 12 are advantageously fabricated from resilient plastic material such as polypropylene, ABS and the like by injection molding or like techniques. The two halves 10 and 12 of the compact are assembled by sliding the body 12 into the interior of cap 10 until the annular projection 30, on the perimeter of the end 20 of body 12, snaps into place in annular groove 32 appropriately located on the interior wall of cap 10. In order to facilitate assembly in this manner end 20 of body 12 is not installed until assembly is completed. Alternatively one or more apertures can be present in end 20 during the assembly of cap and body and these apertures are sealed after assembly is complete.

When so assembled the edge 34 of the end 16 of cap 10 is in closely abutting sliding relationship with the surface of shoulder 36 on body 12. Cap 10 is free to be rotated relative to body 12 about the common axis of these two members between a position (shown in FIG. 2) in which the receptacle 22 in the body 12 is aligned with elongated slot 17 in cap 10 and a position (shown in FIG. 3) in which the said receptacle and slot are located on diametrically opposed sides of the common axis of said body and cap. The rotational movement of cap and body between these two positions is facilitated and controlled by the sliding interaction between the semiannular groove or step 52 on the inner end of the body 12 and stop or rib 54 projecting from the inner surface of the wall of cap 10 at the junction with end 14. Annular projection 30 is in sliding engagement with the walls of annular groove 32 and rotational movement of cap 10 about the body 12 is unrestricted thereby but longitudinal movement of cap 10 with respect to body 12 is prevented.

Figure 1A:
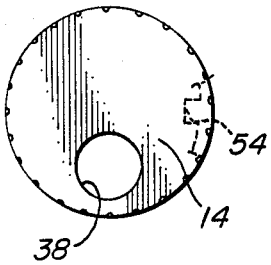
FIG. 1A is a plan view of the end of the cap member of the embodiment shown in FIG. 1.
Figure 1B:
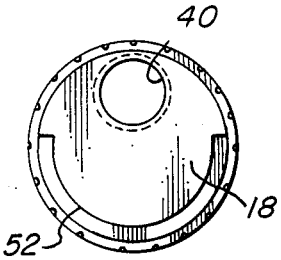
FIG. 1B is a plan view of the inner end of the body member of the embodiment shown in FIG. 1.

As shown in FIGS. 1A and 1B the ends 14 and 16 of the cap 10 and body 12, respectively, have apertures 38 and 40, respectively, which are of substantially equal size. Aperture 40 communicates with storage compartment 24 in body 12 and is of sufficient size to permit insertion or retrieval, in the manner to be described below, of applicator 42 into and from said storage compartment. In the particular embodiment shown in FIG. 1 applicator 42 has an elongated handle 44 provided with applicator tip 46 which can take the form of a brush, felt pad or like applicator means. While the apertures 38 and 40 have been shown with circular cross-section it will be readily appreciated by one skilled in the art that other cross-sections such as square, rectangular, hexagonal, octagonal and the like can be employed if desired.

When the compact shown in FIG. 1 is assembled with the cap 10 and body 12 in the particular configurations shown in that FIGURE the end 18 of body 12 is in close abutting relationship with the inner side of end 14 of cap 10 but the apertures 38 and 40 in said ends are substantially diametrically separated from each other. Similarly, elongated slot 17 is on the opposite side of the assembled compact from the open receptacle 22 in the bosy 12 and the receptacle is closed from access from the exterior by the intervening wall of cap 10.

Figure 2:
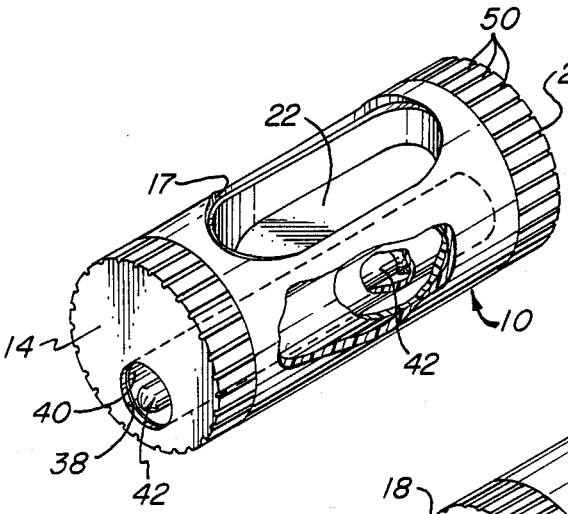
FIG. 2 is a perspective view, partially cut away, of the cosmetic compact shown in FIG. 1 with the cap rotated to give access to the cosmetic preparation receptacle and applicator within the body of the compact.

Rotation of cap 10 about the body 12 brings the elongated slot 17 into registry with the receptacle 22 as shown in perspective view, partly cut away, in FIG. 2. In the position there shown the apertures 38 and 40 have also been brought into registry and applicator 42 can thus be removed from storage compartment 24 by tilting of the compact or other appropriate means.

In an optional, but preferred embodiment of the invention, the ends 14 and 20 are provided with gripping means such as a series of grooves, shown as 48 and 50, which advantageously are disposed longitudinally along a portion of the periphery of the cap and body adjacent the respective ends 14 and 20. Such gripping means facilitate the gripping of the said ends between the thumb and forefinger of each hand of the user when opening or closing the compact.

Figure 3:
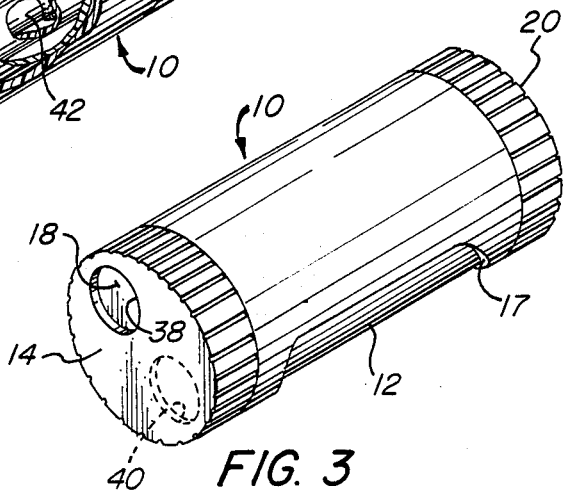
FIG. 3 is a perspective view of the cosmetic compact shown in FIG. 2 with the cap rotated to the closed position.

FIG. 3 is a perspective view of the compact shown in FIG. 2 but with the cap 10 rotated so that the elongated slot 17 no longer registers with the receptacle 22 and the apertures 38 and 40 no longer register with each other. The compact is therefore in the closed position for storage.

The cosmetic compact of the invention has been described above with reference to certain specific embodiments. It is to be understood, however, that these embodiments have been given for purposes of illustration only and are not intended to be limiting. As will be readily appreciated by one skilled in the art various modifications can be made without departing from the scope of the present invention.

What is claimed is:

1. A cosmetic compact comprising in combination:

an outer hollow cylindrical member having one end closed and having an elongated slot in the side wall thereof;

an inner cylindrical member having both ends closed disposed in sliding engagement within said outer cylindrical member;

an open receptacle for a cosmetic preparation disposed in the side wall of said inner cylindrical member;

said outer cylindrical member being rotatable about the common axis of said inner and outer cylindrical members from a closed position of said compact in which said receptacle is covered by the wall of said outer cylindrical member to an open position of said compact in which said elongated slot in said outer cylindrical member registers with said receptacle;

storage means disposed within said inner cylindrical member;

applicator means disposed in said storage means;

an aperture in the end wall of said inner cylindrical member giving access to said storage means, said aperture being adapted to register with a corresponding aperture in the end wall of said outer cylindrical member when said elongated slot is brought into alignment with said receptacle.

said apertures each being of sufficient size to permit said applicator means to pass therethrough.

2. A cosmetic compact according to claim 1 wherein one end of said inner cylindrical member projects out of said outer hollow cylindrical member and is provided with a shoulder peripherally disposed thereon and in sliding abutting relationship with the open end of said outer hollow cylindrical member.

3. A cosmetic compact according to claim 2 wherein said shoulder is ribbed on its periphery to facilitate gripping by thumb and forefinger.

4. A cosmetic compact according to claim 3 wherein the periphery of the closed end of said outer cylindrical member is also ribbed to facilitate gripping thereof.

5. A cosmetic compact according to claim 1 wherein said applicator means comprises an elongated member provided with applicator tip.

6. A cosmetic compact according to claim 1 which also comprises means for preventing relative longitudinal movement of said inner cylindrical member and said outer cylindrical member.

7. A cosmetic compact according to claim 6 wherein said inner cylindrical member is provided with an annular projection adapted to snap into an annular groove in the inner wall of said outer cylindrical member.

8. A cosmetic compact according to claim 1 which also comprises stop means for limiting the angle through which the inner and outer cylindrical members can be rotated relative to each other.

9. A cosmetic compact according to claim 8 wherein said stop means comprises rib means on the inner wall adjacent the closed end of said outer hollow cylindrical member which rib means traverses a semi-annular peripheral groove on the inner end of said inner hollow cylindrical member during rotation of said cylindrical members between the open and closed positions of said compact.

10. A cosmetic compact comprising in combination:

a cylindrical container having an open elongated recess in the side wall thereof adapted to receive a cosmetic preparation;

an elongated storage compartment longitudinally and eccentrically disposed in said container and open at one end thereof;

a hollow cylindrical cover for said container;

said cover adapted to be rotated about the common axis of said cover and container;

an elongated slot in side wall at said cover adapted to register with said recess in the side wall of said cylindrical container upon rotation of said cover; and an aperture in said cover so disposed as to register with the open end of said storage compartment in said container when said slot in said cover is caused to register with said recess in said container.

11. A cosmetic compact according to claim 10 which also comprises cosmetic applicator means disposed within said storage compartment and adapted to be removable therefrom when said aperture in said cover is caused to register with the open end of said storage compartment.

12. A cosmetic compact according to claim 11 wherein said applicator means comprises an elongated member provided with an applicator tip.

13. A cosmetic compact according to claim 10 which also comprises means for preventing relative longitudinal movement of said cover with respect to said container.

14. A cosmetic compact according to claim 13 wherein said means comprises an annular projection on said container disposed within said cover which projection engages an annular groove in the inner wall of said cover.

15. A cosmetic compact according to claim 10 wherein said container is provided with a shoulder in abutting sliding relationship with said cover when the latter is in place on said container.

16. A cosmetic compact according to claim 15 wherein the surface of said shoulder is ribbed to facilitate gripping by thumb and forefinger.

17. A cosmetic compact according to claim 16 wherein the periphery of said cover is also ribbed to facilitate gripping thereof by thumb and forefinger.

18. A cosmetic compact according to claim 10 which also comprises stop means for limiting the angle through which the said cover can be rotated.

19. A cosmetic compact according to claim 18 wherein said stop means comprises rib means disposed on the inner wall of said cover which rib means traverses a semi-annular groove on the inner end of said container during rotation of said cover from a position in which said slot ins aid cover registers with said recess in said container to a position in which said recess is covered by the wall of said container.

* * * * *